US006105959A

United States Patent [19]

Miyata et al.

[11] Patent Number: 6,105,959

[45] Date of Patent: Aug. 22, 2000

[54] OVERLAPPED FEED DETECTING DEVICE

[75] Inventors: Masakazu Miyata; Mashiro Nishihata, both of Ibaraki-ken, Japan

[73] Assignee: Riso Kagaku Corporation, Tokyo, Japan

[21] Appl. No.: 09/106,862

[22] Filed: Jun. 30, 1998

[30] Foreign Application Priority Data

Jul. 2, 1997 [JP] Japan ..... 9-177442

[51] Int. Cl.[7] ..... B65H 7/12

[52] U.S. Cl. ..... 271/263; 271/258.01; 271/262; 271/256

[58] Field of Search ..... 271/263, 258.01, 271/262, 256

[56] References Cited

U.S. PATENT DOCUMENTS

| | | | |
|---|---|---|---|
| 3,578,315 | 5/1971 | Milford | 271/47 |
| 4,160,546 | 7/1979 | McMillan et al. | 271/263 |
| 4,652,742 | 3/1987 | Wauer et al. | 250/263 X |
| 5,067,704 | 11/1991 | Tsuihiji et al. | 271/262 |
| 5,105,078 | 4/1992 | Nochise et al. | 250/263 X |

FOREIGN PATENT DOCUMENTS

| | | | |
|---|---|---|---|
| 0 445 835 | 9/1991 | European Pat. Off. . | |
| 0 707 383 | 4/1996 | European Pat. Off. . | |
| 3710-161 | 3/1987 | Germany | 271/263 |
| 109342 | 6/1983 | Japan | 271/263 |
| 97941 | 6/1984 | Japan | 271/263 |
| 60-188 252 | 9/1985 | Japan . | |
| 02109191A | 4/1990 | Japan | 271/263 |
| 06 036 249 | 2/1994 | Japan . | |
| 1131-806 | 2/1983 | Russian Federation | 271/263 |

OTHER PUBLICATIONS

European Search Report.

*Primary Examiner*—Christopher P. Ellis
*Assistant Examiner*—Richard Ridley
*Attorney, Agent, or Firm*—Nixon Peabody LLP; Donald R. Studebaker

[57] ABSTRACT

Overlapped paper feed can be detected easily and promptly. Along a paper feeding path, a light emitting element 1 and a light receiving sensor 2 are placed face to face and a detection signal corresponding to the light transmissivity of paper is output. The detection signal is not amplified by one system and amplified at a predetermined amplification ratio via an amplifying circuit 3 in the other system. An A/D converter 5*a* or 5*b* is set in each system and outputs the detection signal to a CPU 6 after sampling the detection signal. The CPU 6 detects overlapped feed by selecting the system whose detection signal value is within the effective range which is not effected by noise and not at a saturation level.

8 Claims, 8 Drawing Sheets

OVERLAPPED FEED DETECTING DEVICE

BACKGROUND OF THE INVENTION

1. Field of the Invention

The present invention is installed in an apparatus for feeding paper or the like, and relates to a device for detecting overlapped paper feed.

2. Description of the Related Art

A paper feeding apparatus which is applied to a printer, a copier or the like feeds paper along a feeding path. In the paper feeding apparatus, a device for detecting overlapped feed of paper to be fed is set.

An overlapped feed detecting device has a light transmission type sensor comprising a light emitting element and a light receiving sensor placed face to face along the feeding path so that it can detect overlapped feed of paper based on an output value in response to a state of light transmission.

To detect double feeding of thin or thick paper by using one light transmission type sensor, it is necessary to adjust the light emission from the light emitting element and the amplification ratio of the output from the light receiving sensor (the sensibility of the light receiving sensor) in accordance with the thickness of the paper or the like to be used. FIG. 8 is a diagram showing a configuration of such a conventional overlapped feed detecting device.

The light emission from a light emitting element 40 is manually adjusted by using a manual light emission adjustment circuit 41*a*. The light is received by a light receiving sensor 42 facing the light emitting element 40, between which paper is fed. The output from the light receiving sensor 42 is input to an amplifying circuit 43, and the amplification ratio is manually adjusted by using a manual amplification ratio adjustment circuit 44*a*. An output signal amplified at the amplification ratio is A/D-converted by an A/D converter 46 installed in a microcomputer 45 and input to a CPU 47.

The CPU 47 is connected with both a ROM 48 and a RAM 49 and judges overlapped paper feed based on the input signal. When overlapped feed is detected, an overlapped feed warning lamp 50 installed in an operation panel or the like flashes and processing used in unusual situation, such as suspension of paper feed, is carried out.

In the above configuration, the light emission from the light emitting element 40 and the amplification ratio of the amplifying circuit 43 are increased for thick paper which has low light transmissivity, while decreased for thin paper which has high light transmissivity. A user needs to carry out this adjustment by using the manual light emission adjustment circuit 41*a* or the manual amplification ratio adjustment circuit 44*a*, which is time consuming and may cause erroneous setting.

To solve the inconvenience associated with the manual setting, there has been another method which automatically adjusts the light emission from the light emitting element 40 or the amplification ratio for amplifying the output from the light receiving sensor 42 in response to the thickness of paper to be used. FIG. 9 is a diagram showing a configuration of such an overlapped feed detecting device.

In this device, the CPU 47 changes the light emission from the light emitting element 40 and the amplification ratio of the amplifying circuit 43 in order to make the output signal from the light receiving sensor 42 appropriate for overlapped feed detection. In other words, the CPU 47 automatically adjusts a light emission adjustment circuit 41*b* or an amplification ratio adjustment circuit 44*b*.

However, in this method, an algorithm for adjustment is complicated, which makes a program for automatic adjustment processing complex. Furthermore, since repeated adjustment and judgment is necessary, it is time consuming to adjust optimally.

SUMMARY OF THE INVENTION

The present invention has been created to solve the problems having been described above and its object is to provide a device which can detect overlapped paper feed easily and promptly.

To achieve the above object, an overlapped feed detecting device of the present invention comprises a light emitting element;

a light receiving sensor which outputs a detection signal and faces the light emitting element via paper fed along a paper feeding path between the light receiving sensor and the light emitting element;

a plurality of amplifiers which amplify the detection signal output from the light receiving sensor at different amplification ratios; and processing means which selects an appropriate amplifier among the plurality of amplifiers in response to the magnitude of the detection signal output from the light receiving sensor and detects overlapped paper feed by comparing the detection signal amplified by the amplifier and a reference data corresponding to the thickness of the paper having been recorded as a reference.

Furthermore, another overlapped feed detecting device comprises a light emitting element;

a light receiving sensor which outputs a detection signal and faces the light emitting element via paper fed along a paper feeding path between the light receiving sensor and the light emitting element;

an amplifier which amplifies the detection signal output from the light receiving sensor; and processing means which selects either the detection signal amplified by the amplifier or the detection signal not having been amplified and detects overlapped paper feed by comparing the selected detection signal with a reference data corresponding to the thickness of the paper having been recorded as a reference.

The overlapped feed detecting device may comprise an A/D converter which is used before processing by the processing means and carries out digital sampling of the detection signal to output the detection signal to the processing means.

The overlapped feed detecting device may have a configuration wherein a single A/D converter composes the A/D converter in the above and switches the plurality of detection signals in time division and outputs the detection signals to the processing means, and the processing means detects overlapped feed based on each of the detection signals switched in time division.

The processing means may externally warn a state wherein overlapped feed detection is unable when all of the plurality of detection signals have inappropriate values.

The light from the light emitting element is detected by the light receiving sensor, transmitting through the paper fed along the paper feeding path, and a detection signal corresponding to the light transmissivity of the paper is output. The detection signal is amplified by the amplifiers at different amplification ratios for each system, and digitized by the A/D converter to be input to the processing means. The processing means selects a system which shows an appropriate value among the detection signals from each system and detects overlapped feed thereby.

A reference data corresponding to the thickness of reference paper has been stored in the processing means and overlapped feed is detected by comparing the detection signal showing the value corresponding to the light transmissivity of the paper with the reference data at each time paper is fed.

DESCRIPTION OF THE PREFERRED EMBODIMENTS

Figure 1:
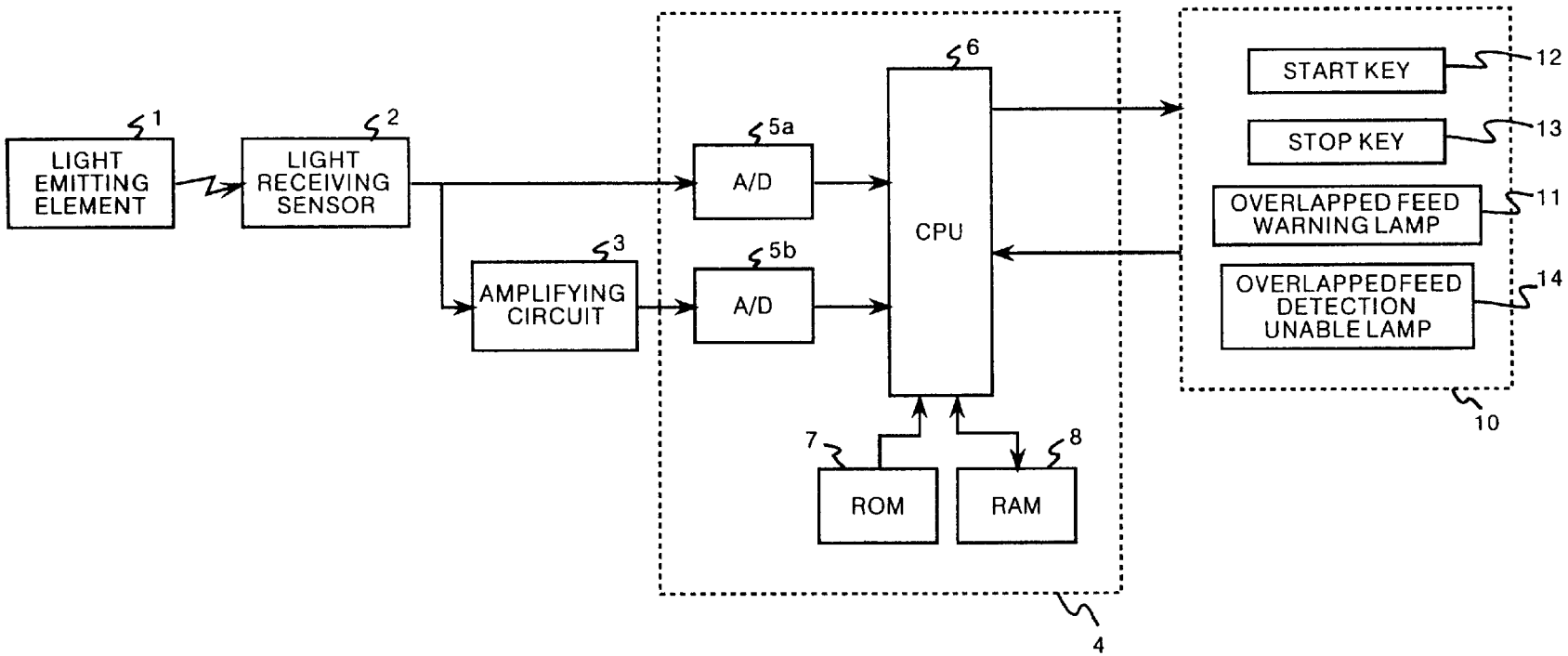
FIG. 1 is a diagram showing a configuration of an embodiment of an overlapped feed detecting device of the present invention.

FIG. 1 is a configuration diagram showing a first embodiment of an overlapped feed detecting device of the present invention.

The present invention is to be applied on a printer, a copier or the like, and detects overlapped feed of paper or the like along a feeding path.

A light transmission type sensor comprising a light emitting element 1 and a light receiving sensor 2 facing each other and having the feeding path therebetween is placed. A detection signal at a value corresponding to a light transmission state, that is, the thickness of the paper, is output from the light receiving sensor 2.

The output from the light receiving sensor 2 (whose amplification ratio is 1) is input to processing means 4 comprising a microcomputer. In the microcomputer, an A/D converter 5*a* is provided which carries out A/D conversion of the detection signal and outputs the detection signal to a CPU 6.

The output from the light emitting element 2 is parallel input to an amplifying circuit 3 which amplifies and outputs the signal at a predetermined amplification ratio (for example, 9.2).

The output signal from the amplifying circuit 3 is A/D-converted via an A/D converter 5*b*, and input to the CPU 6. Both A/D converters 5*a* and 5*b* have the same configuration and the same scale (for example, if 8-bit, 0 to 255 level resolution).

Figure 2:
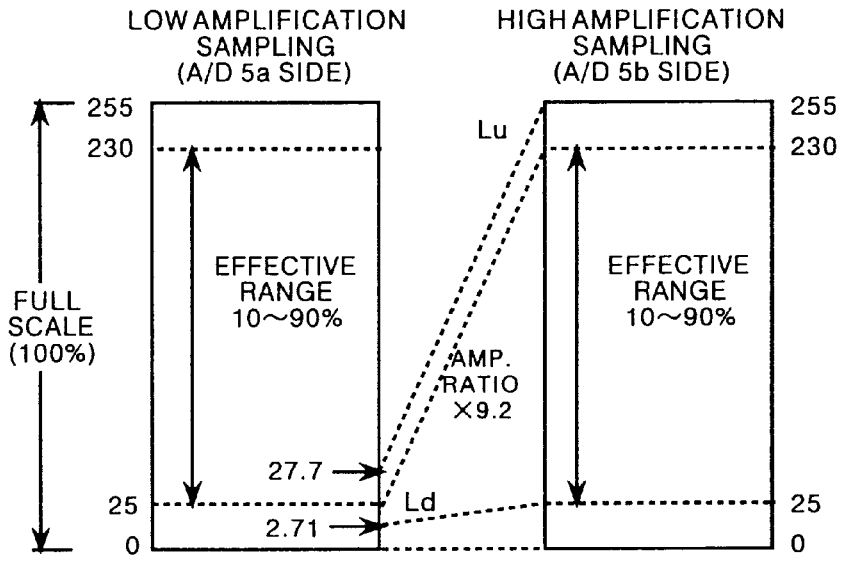
FIG. 2 is a schematic diagram showing effective ranges of sampling.

FIG. 2 shows the scale ranges of both converters 5*a* and 5*b*. As shown in this figure, a portion of the output in the scale of the A/D converter 5*a* which carries out low amplification sampling is magnified and output by the A/D converter 5*b* which carries out high amplification sampling.

It is not preferable for the A/D converters 5*a* and 5*b* to use the entire scale ranges. In other words, the converters have a characteristic that they have decreasing sampling performance in predetermined ranges close to the upper and lower limits (for example, ranges equal to or lower than 10% and equal to or higher than 90% of the scales). Therefore, if the value of the detection signal is in the range close to the lower limit of the converter, a noise effect tends to appear, and in the range close to the upper limit, an effect caused by saturation tends to be created.

For these reasons, it is assumed that these A/D converters are used in the effective ranges (for example, within 10~90%) where an effect caused by the characteristic tends to be avoided. The amplification ratio of the amplifying circuit 3 is set so that a lower limit Ld of the effective range of the low amplification sampling A/D converter 5*a* and an upper limit Lu of the effective range of the high amplification sampling A/D converter 5*b* are at a level the same as or partially overlapping the value of the detection signal.

For example, if the A/D converters 5*a* and 5*b* are in 8-bit (having 0~255 level resolution) and the effective ranges thereof are set to 10~90%, the lower limit Ld of the effective range of the low amplification sampling A/D converter 5*a* is 25. Accordingly, the upper limit Lu of the effective range of the high amplification sampling A/D converter 5*b* is set to a value equal to or greater than the level 25 of the low amplification sampling converter. In other words, if the amplification ratio of the high amplification sampling side is set to a value equal to or smaller than 9.2, the lower limit Ld of the effective range of the low amplification sampling and the upper limit Lu of the effective range of the high amplification sampling become consecutive. Therefore, if the detection signal at the value equivalent to Ld and Lu (level 25) is input, the signal is in effective ranges of both A/D converters 5*a* and 5*b*, and sampling is thus carried out without effects of noise or saturation.

In the above explanation, a configuration has been described wherein the lower limit Ld of the effective range of the low amplification sampling converter and the upper limit Lu of the effective range of the high amplification sampling converter are at the same level. If the amplification ratio of the amplifying circuit 3 is reduced further, the effective range of the low amplification sampling converter overlaps that of the high amplification sampling converter.

Figure 3:
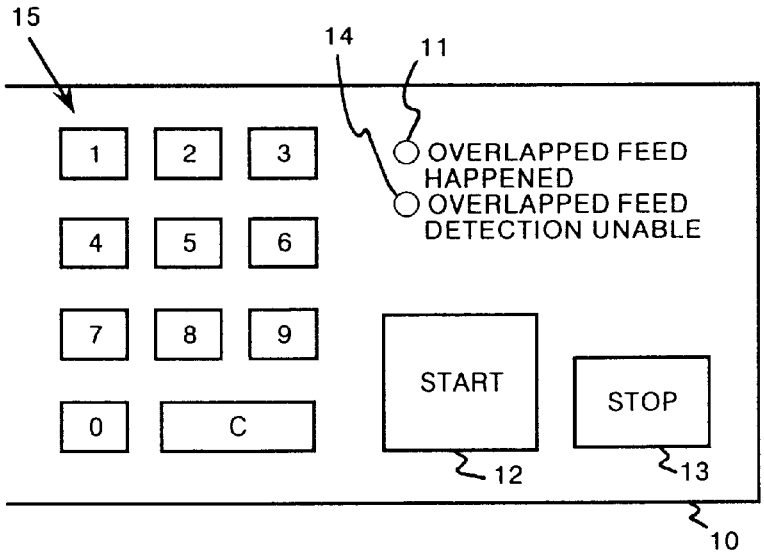
FIG. 3 is a diagram showing an operation panel.

The CPU 6 is connected with both a ROM 7 and a RAM 8 and judges overlapped paper feed in a procedure which will be described later, based on the output signals from the A/D converters 5*a* and 5*b*. When overlapped feed is detected, the CPU 6 makes an overlapped feed warning lamp 11 installed in an operation panel shown in FIG. 3 flash and processing used in unusual situation, such as suspension of paper feed, is carried out.

The operation panel 10 has a start key 12 for starting printing, a stop key 13 for interrupting printing, an overlapped feed detection unable lamp 14 which flashes when the CPU 6 judges that it is unable to detect overlapped feed, and ten keys 15 for setting the quantity of print or the like.

Hereinafter, an overlapped feed detection operation by the above apparatus will be explained with reference to the flow charts in FIGS. 4 through 6.

Figure 4:
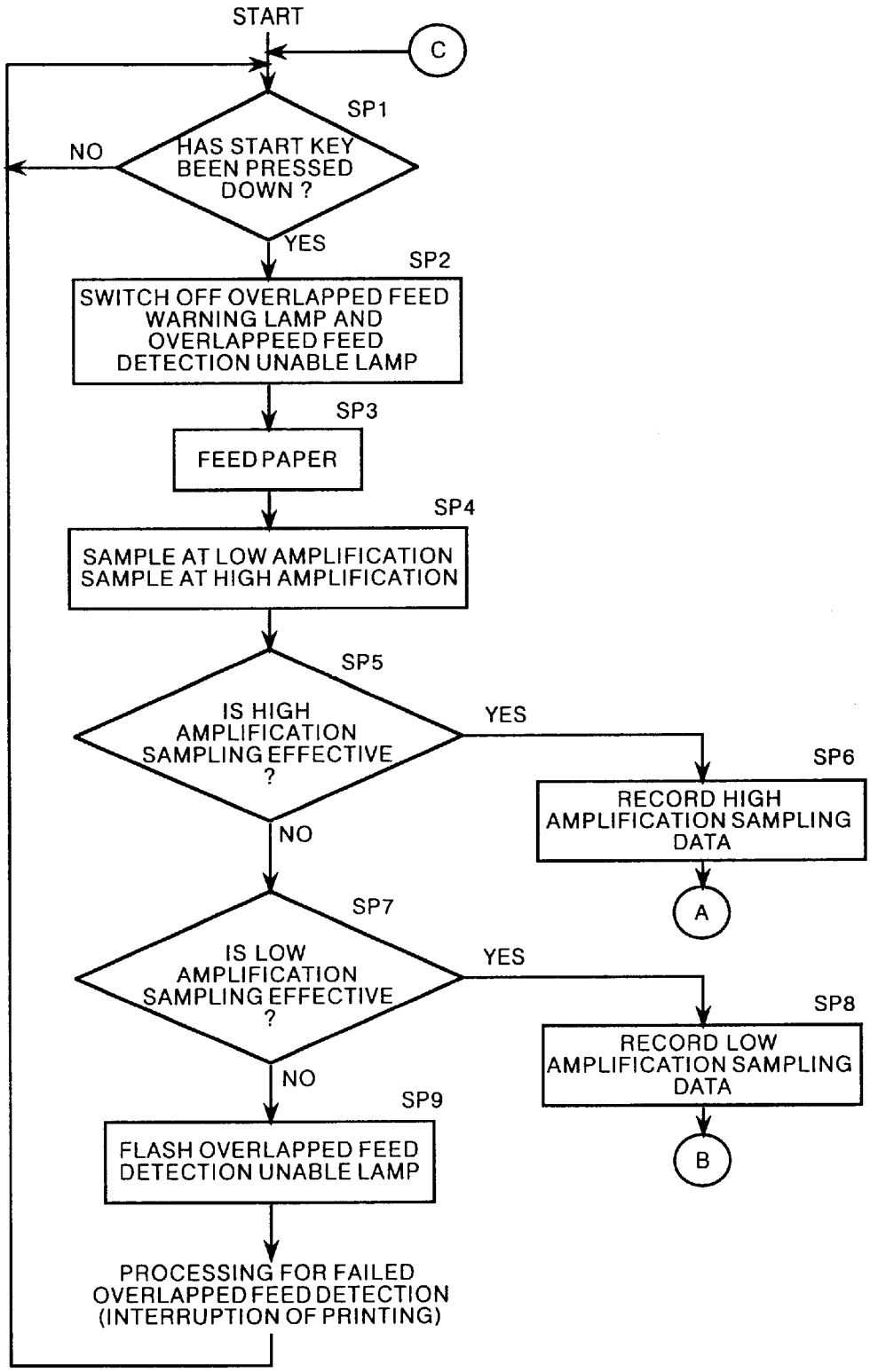
FIG. 4 is a flow chart showing an operation of the device (part 1)

In FIG. 4, when the start key 12 for starting printing is pressed down (SP1-Yes), initial setting is carried out and the overlapped feed warning lamp 11 and the overlapped feed detection unable lamp 14 are switched off (SP2). Assume that no overlapped feed has occurred when the start key 12 is pressed down.

A paper feeder unit of the printer then feeds paper (SP3). By this paper feed, the paper is fed along a feeding path reaching a printing unit and a paper discharging unit.

The light emitting element 1 and the light receiving sensor 2 are placed face to face with the feeding path being placed therebetween. From the light receiving sensor 2, the detection signal at a value corresponding to the state of light transmissivity, that is, the thickness of the paper is output. The detection signal from the light receiving sensor 2 is sampled digitally by both A/D converters 5*a* and 5*b* (SP4).

The sampling at this stage is carried out on the paper fed first, and the sampling data of the first paper is input to the CPU 6 and will be used in later process as a reference data for judging overlapped feed.

The A/D converter 5*b* carries out digital sampling of the detection signal having been amplified by the amplifying circuit 3 at an amplification ratio equal to or greater than 1-digit number (9.2) and outputs the signal to the CPU 6. The other A/D converter 5*a* carries out digital sampling on the detection signal which has not been amplified and outputs the signal to the CPU 6. Both A/D converters 5*a* and 5*b* carry out the sampling on the same detection signal after the amplification of the detection signal at different amplification ratios.

In this manner, if the paper to be used is comparatively thick and the value of the detection signal is at level 10 (the value of resolution after the digital conversion) for example, the output from the low amplification sampling converter 5*a* is below the lower limit Ld and out of the effective range of the converter, which is prone to be affected by noise. On the other hand, since the high amplification sampling converter 5*b* samples the signal at level 92 which has been amplified by 9.2 times (i.e., the level of the original detection signal is 10), this value is in the middle of the scale and does not tend to be affected by noise. Therefore, it is appropriate to use the output from the high amplification sampling converter 5*b*.

If the paper to be used is comparatively thin, such as tracing paper, and the level of the detection signal is 180 for example, the level of the detection signal sampled by the high amplification sampling converter 5*b* at the amplification ratio of 9.2 becomes 1656, which causes saturation. Therefore, it is appropriate to use the output from the low amplification sampling converter 5*a*.

As has been described above, by separately sampling the detection signal at predetermined amplification ratios by using separate A/D converters 5*a* and 5*b*, a sampling data unaffected by the A/D converter characteristics can be output.

Between the sampling data having been sampled at a low amplification ratio by using the A/D converter 5*a* and the sampling data having been sampled at a high amplification ratio by using the A/D converter 5*b*, the CPU 6 obtains the sampling data from one of the A/D converters 5*a* and 5*b* showing an appropriate value.

Therefore, the CPU 6 judges the output from one of the A/D converters 5*a* and 5*b* "effective" when the sampling data having been obtained is in the effective range of the scale (10~90% of the full scale) of the A/D converter 5*a* or 5*b*.

When the output from the high amplification sampling A/D converter 5*b* has been judged to be effective (SP5-Yes) after the processing at SP4,. the high amplification sampling data from the A/D converter 5*b* is recorded in a predetermined recording area of the RAM 8, and effectiveness of the high amplification sampling data is set and selected (SP6). The value of the original data (the output from the light receiving sensor 2) within the effective range of the high amplification sampling converter 5*b* is at 2.7~25.

When the high amplification sampling data has been judged not to be effective (SP5-No), it is judged whether the output from the low amplification sampling A/D converter 5*a* is effective or not. When it is judged to be effective (SP7-Yes), the low amplification sampling data from the A/D converter 5*a* is stored in a predetermined recording area of the RAM 8, and effectiveness of the low amplification sampling data is set and selected (SP8).

When the low amplification sampling data has also been judged not to be effective (SP9), the output from both A/D converters 5*a* and 5*b* is not effective. Therefore, the sampling data obtained by using the first paper are judged not to be usable as the reference data for overlapped feed detection which will be explained later, and the overlapped feed detection unable lamp 14 flashes (SP9). Various kinds of processing used in failed overlapped feed detection, such as interruption of printing, is carried out and the initial state (SP1) is resumed.

Such "detection unable" state occurs when the paper fed is transparent such as a transparent film or thick paper such as cardboard. In other words, it happens when the light transmissivity is too good or too poor. The sampling data in this situation has a value which is out of effective ranges of the low amplification sampling converter and the high amplification sampling converter. These sampling data cannot be used as the reference data for overlapped paper feed detection based on a change in light transmissivity.

When the sampling data from the high amplification sampling A/D converter is judged to be effective at SP6, overlapped feed detection is carried out based on the output from the high amplification sampling converter 5*b* having been selected. The procedure of the overlapped feed detection is shown in the flow chart in FIG. 5.

When the high amplification sampling A/D converter 5*b* is selected, the paper often tends to be comparatively thick and the light transmissivity of the paper is comparatively low. Therefore, the detection signal is amplified by the amplifying circuit 3.

A series of printing processing wherein the first paper is fed along the feeding path and discharged after printing completion is then carried out (SP1).

For paper fed second and thereafter, overlapped feed detection processing which will be described below is carried out continuously until the stop key 13 is pressed down (SP11-Yes).

When second paper is fed (SP12), the detection signal after amplification thereof is sampled by the high amplification sampling A/D converter 5*b* which has been selected (SP13).

The CPU 6 reads the reference sampling data from the RAM 8, and compares it with the sampling data detected at this time (for the second paper) (SP14). As a result, if the current sampling data is within a predetermined range when compared with the reference data, it is judged "normal" (SP15-No), and the processing goes on to SP10. The overlapped feed detection processing is then carried out for third paper and thereafter.

Meanwhile, if the current sampling data is found to have a small value below the predetermined range when compared with the reference data as a result of the comparison at SP15, it is judged as "overlapped feed happened" (SP15-Yes), and the overlapped feed warning lamp 11 flashes. The processing used at occurrence of overlapped feed, such as interruption of printing, is carried out and the procedure goes back to the initial state (SP1).

In the comparison processing described above, the reference sampling data has a value corresponding to the light transmissivity of the first paper. If the paper fed second or thereafter is fed overlapping another paper sheet, the light transmissivity decreases and the current sampling data is smaller than the reference data. Based on this, "overlapped feed happened" can be detected.

The predetermined range is set so that the range corresponds to a fluctuation in the light transmissivity of the paper, such as the thickness of the paper fed every time.

Figure 5:
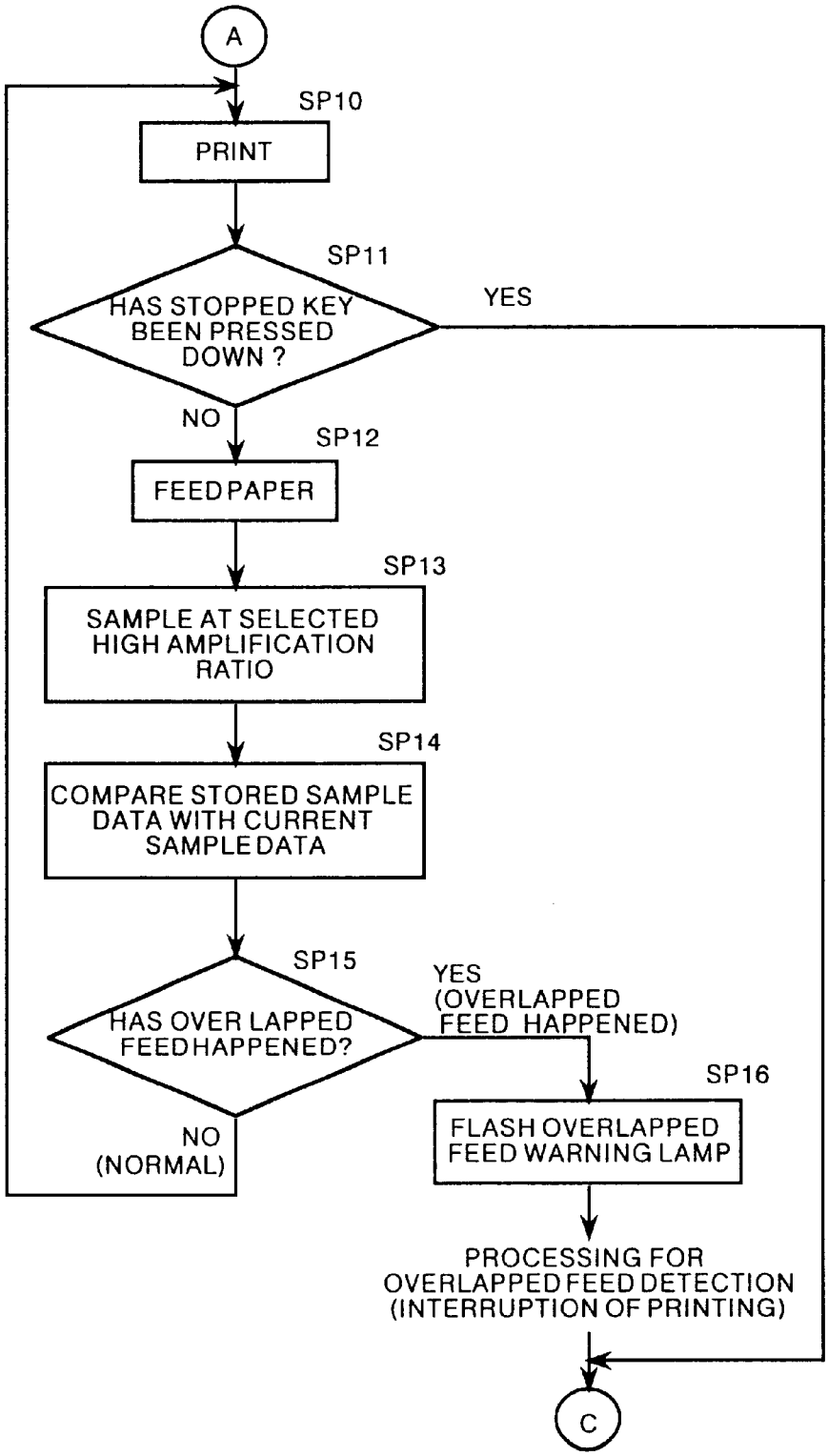
FIG. 5 is a flow chart showing an operation of the device (part 2)
Figure 6:
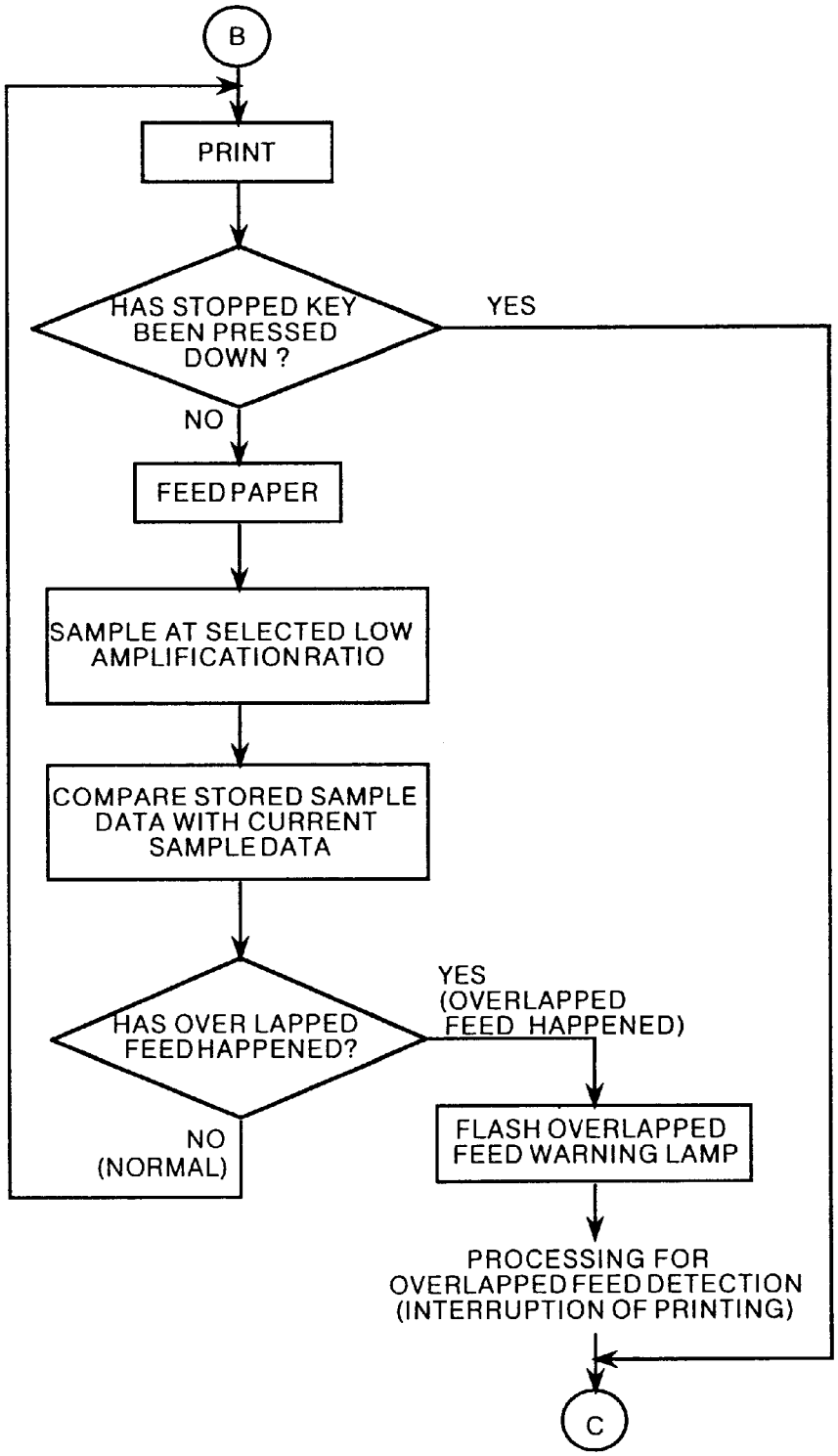
FIG. 6 is a flow chart showing an operation of the device (part 3)

In FIG. 6, the process almost the same as in FIG. 5 is described. The processing in FIG. 6 is carried out after the processing at SP8, and the overlapped feed detection processing using the low amplification sampling A/D converter 5*a* is described in FIG. 6. Therefore, explanation regarding FIG. 6 is omitted here.

When the low amplification sampling A/D converter 5*a* is selected, the paper is often comparatively thin and has comparatively high light transmissivity. Therefore, the output from the light receiving sensor 2 can be used as the sampling data without amplification thereof.

The light receiving sensor 2 is configured so that various voltage output can be obtained due to I–V characteristics at the time of designing thereof, and the output can be input directly to the A/D converter 5*a* without going through the amplifying circuit 3.

In the above configuration, the paper fed second or thereafter is checked for overlapped feed after either the low amplification sampling A/D converter 5*a* or the high amplification sampling A/D converter 5*b* has been selected and the selected converter is used fixedly. However, another configuration may be used wherein the output from both A/D converters 5*a* and 5*b* are referred to each time the paper is fed and overlapped feed is detected by using the output from the converter showing an appropriate value, that is, the value within the effective range.

In this case, at SP13, sampling is carried out by both low and high amplification sampling converters, and at SP14 the sampling data from the converter showing an appropriate value is compared to judge overlapped feed at SP15.

As has been described above, if the output from the light receiving sensor 2 is sampled by both low and high amplification sampling converters and the converter showing an appropriate value is selected, detection of overlapped feed of thick and thin paper having different light transmissivity can be carried out by using only one light transmission type sensor. In this case, it is not necessary to adjust the light emission from the light emitting element 1 or the amplification ratio of the light receiving sensor 2 (the sensibility of the light receiving sensor 2) in response to the thickness of the paper to be used.

Figure 7:
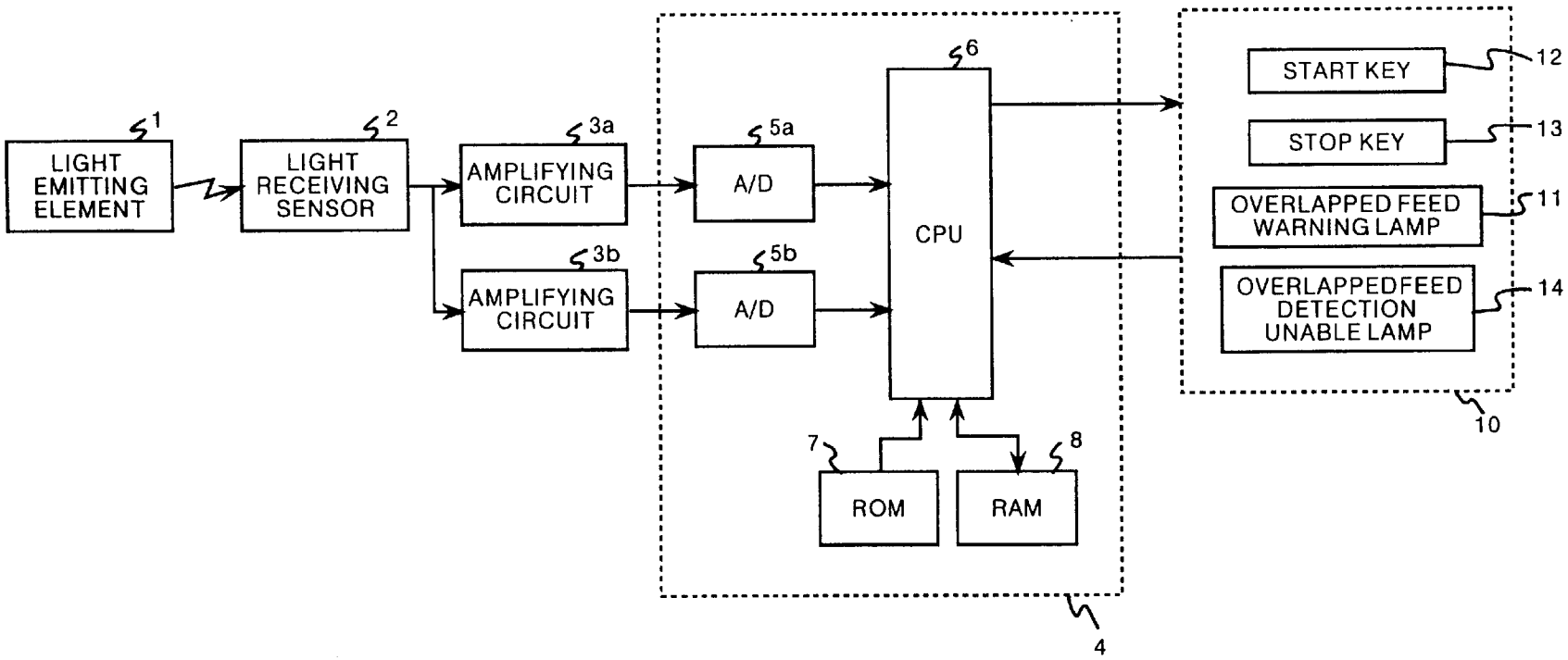
FIG. 7 is a diagram showing a configuration of a second embodiment of the overlapped feed detecting device of the present invention.
Figure 8:
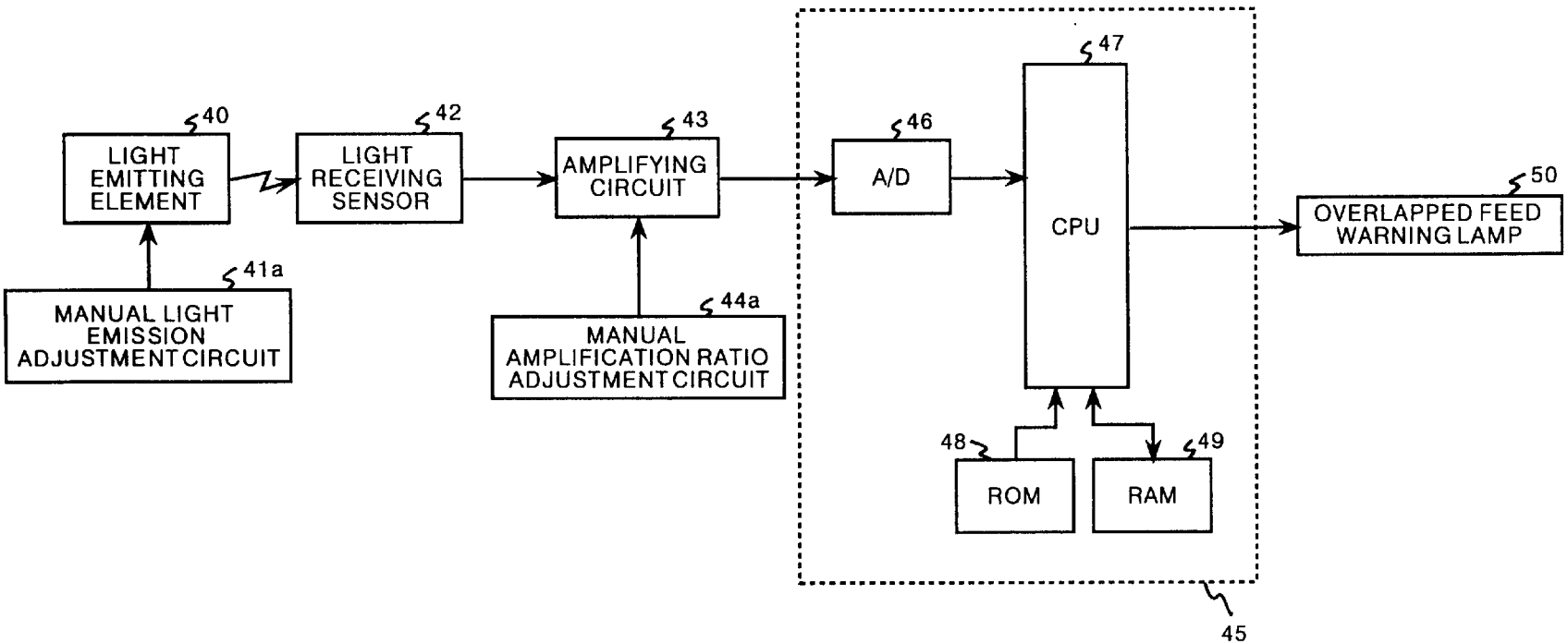
FIG. 8 is a diagram showing a configuration of a conventional overlapped feed detecting device.
Figure 9:
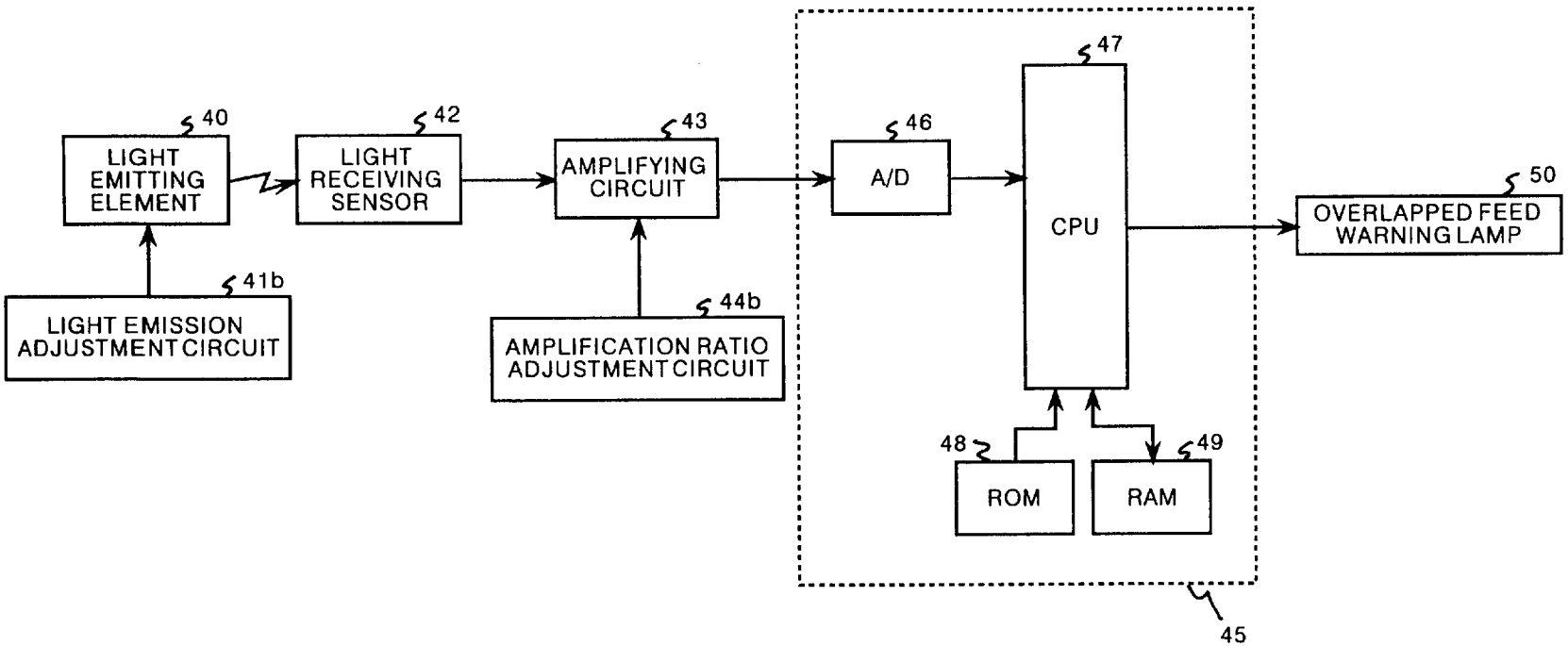
FIG. 9 is a diagram showing a configuration of another conventional overlapped feed detecting device.

In FIG. 7, a second embodiment of the present invention is shown.

In this embodiment, the basic configuration is the same as in the first embodiment. However, it is different from the first embodiment that the detection signal output from the light receiving sensor 2 is amplified by both amplifying circuits 3*a* and 3*b* and output to A/D converters 5*a* and 5*b*.

In other words, when the level of the detection signal output from the light receiving sensor 2 is low and the detection signal would be affected by noise if it were used as it is, the detection signal needs to be amplified by the amplifying circuits 3*a* and 3*b*, as in this configuration.

Assume that both A/D converters 5*a* and 5*b* are used in their effective ranges wherein the effect caused by the characteristic of the converters does not tend to appear (for example, 10~90%). The amplifying circuits 3*a* and 3*b* are configured so that they have predetermined different amplification ratios. For example, the amplifying circuit 3*a* has a low amplification ratio, while the amplifying circuit 3*b* is set to have a high amplification ratio.

The amplification ratios of the amplifying circuits 3*a* and 3*b* are set so that the lower limit Ld of the effective range of the low amplification sampling A/D converter 5*a* and the upper limit Lu of the effective range of the high amplification sampling A/D converter 5*b* are at a level the same as or partially overlapping the value of the detection signal.

The overlapped feed detection can be carried out according to the flow charts shown in FIGS. 4 to 6 by using this configuration.

In the above embodiments, the A/D converters 5*a* and 5*b* divided in two systems are used as the low and high amplification sampling converters and the converter appropriate for overlapped feed detection is selected. The number of division may not be limited to two however, and three or more can be adopted. By letting the amplification ratios of the detection signal have more various values, overlapped feed detection can be carried out more precisely.

In the configuration wherein three or more divided systems are used, one of the divided systems may not have the amplifying circuit 3 (as in the first embodiment).

In the above embodiments, the A/D converters 5*a*, 5*b*, . . . for each of the divided systems are used. Regardless of the number of division, the CPU 6 may obtain the detection signal output from each system in time division by using a single A/D converter. In this case, a switch for inputting the output from each system to the single A/D converter in time division is placed between the input of the A/D converter and the output of each amplifying circuit.

In the above embodiments, the processing means 4 wherein the microcomputer installs the A/D converters 5*a* and 5*b* is used as an example. However, the A/D converters may be installed outside the microcomputer, that is, outside the processing means 4.

According to the present invention, in overlapped feed detection based on light transmissivity of paper, the output from the light receiving sensor is amplified at different amplification ratios by a plurality of systems, and the system whose detection signal shows an appropriate value is selected. Therefore, overlapped paper feed can be detected promptly by a simple configuration.

Furthermore, since overlapped feed is detected by amplifying the detection signal at different amplification ratios by using each system, overlapped feed of paper in various range of thickness, from thin to thick, can be detected.

According to the device of the present invention, since it is not necessary to adjust the light emission from the light emitting element or the amplification ratio of the light receiving sensor during operation, adjustment of the device is not time consuming.

What is claimed is:

1. An overlapped feed detecting device comprising:

a light emitting element;

a light receiving sensor which outputs a detection signal and faces the light emitting element via paper fed along a paper feeding path between the light receiving sensor and the light emitting element;

a plurality of amplifiers which amplify the detection signal output from the light receiving sensor at different amplification ratios; and selection means for selecting an appropriate amplifier among the plurality of amplifiers in response to the magnitude of the detection signal output from the light receiving sensor and detects overlapped paper feed by comparing the detection signal amplified by the amplifier with a reference data corresponding to the thickness of the paper having been recorded as a reference.

2. An overlapped feed detecting device comprising:

a light emitting element;

a light receiving sensor which outputs a detection signal and faces the light emitting element via paper fed along a paper feeding path between the light receiving sensor and the light emitting element;

an amplifier which amplifies the detection signal output from the light receiving sensor; and selection means for selecting either the detection signal amplified by the amplifier or a detection signal that has not been amplified by the amplifier and detects overlapped paper feed by comparing the selected detection signal with a reference data corresponding to the thickness of the paper having been recorded as a reference.

3. The overlapped feed detecting device as claimed in claim 1 which comprises an A/D converter used before processing by the selection means and carries out digital sampling of the detection signal to output the detection signal to the selection means.

4. The overlapped feed detecting device as claimed in claim 3 wherein the A/D converter includes a single A/D converter which processes a plurality of detection signals in time division and outputs the detection signals to the selection means, and the selection means detects overlapped feed based on each of the detection signals switched in time division.

5. The overlapped feed detecting device as claimed in claim 2 which comprises an A/D converter used before processing by the selection means and carries out digital sampling of the detection signal to output the detection signal to the selection means.

6. The overlapped feed detecting device as claimed in claim 1 wherein the selection means externally warns a state in which overlapped feed detection is unabled when the detection signals have inappropriate values.

7. The overlapped feed detecting device as claimed in claim 2 wherein the selection means externally warns a state in which overlapped feed detection is unabled when the detection signals have inappropriate values.

8. The overlapped feed detecting device as claimed in claim 5 wherein the A/D converter includes a single A/D converter which processes a plurality of detection signals in time division and outputs the detection signals to the selection means, and the selection means detects overlapped feed based on each of the detection signals switched in time division.

* * * * *